US009448007B2

(12) United States Patent
Tunzi

(10) Patent No.: US 9,448,007 B2
(45) Date of Patent: Sep. 20, 2016

(54) SHELVING ASSEMBLY FOR REFRIGERATOR COMPARTMENT

(71) Applicant: Whirlpool Corporation, Benton Harbor, MI (US)

(72) Inventor: Todd Tunzi, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/984,259

(22) Filed: Dec. 30, 2015

(65) Prior Publication Data

US 2016/0109173 A1 Apr. 21, 2016

Related U.S. Application Data

(63) Continuation of application No. 13/788,418, filed on Mar. 7, 2013, now Pat. No. 9,261,305.

(51) Int. Cl.

| | |
|---|---|
| ***A47B 96/04*** | (2006.01) |
| ***F25D 25/02*** | (2006.01) |
| ***F25D 23/06*** | (2006.01) |
| ***F25D 27/00*** | (2006.01) |
| *A47B 57/08* | (2006.01) |

(52) U.S. Cl.

CPC ..... *F25D 25/021* (2013.01); *F25D 23/062* (2013.01); *F25D 25/02* (2013.01); *F25D 27/00* (2013.01); *A47B 57/08* (2013.01); *Y10T 29/49826* (2015.01)

(58) Field of Classification Search

CPC ..... F25D 23/065; F25D 2325/021; F25D 25/02; A47B 57/08

See application file for complete search history.

(56) References Cited

U.S. PATENT DOCUMENTS

| | | | | | |
|---|---|---|---|---|---|
| 391,438 | A * | 10/1888 | Van Horn | A47B 57/567 | 248/244 |
| 569,640 | A * | 10/1896 | Hartzell | A47B 57/567 | 108/147.11 |
| 3,261,585 | A * | 7/1966 | Costantini | A47B 88/044 | 248/243 |
| 3,865,337 | A * | 2/1975 | Towfigh | A47B 57/56 | 248/246 |
| 4,223,863 | A * | 9/1980 | Birman | A47B 57/56 | 108/108 |
| 4,250,815 | A * | 2/1981 | Swanson | A47F 5/13 | 108/108 |
| 4,901,965 | A * | 2/1990 | Bowman | A47B 57/56 | 108/108 |
| 5,004,302 | A * | 4/1991 | Stocking | A47B 57/42 | 108/107 |

(Continued)

*Primary Examiner* — Hanh V Tran

(57) ABSTRACT

A shelving assembly includes ladder rails mounted within spaced elongated pockets formed in the rear wall of a refrigerator compartment. Each ladder rail presents a front, side, rear wall portions. Adjacent the front wall portion, a vertical slot is defined, at least in part, by an in-turned portion of the front wall portion. Offset from the slot, the in-turned portion is formed with a plurality of vertically spaced and rearwardly projecting hooks. Each shelf of the assembly includes arms, each having an anchoring pin and a support foot. In mounting the shelf, the support foot and the anchoring pin of each arm are placed through a cutout formed in the front wall portion of a respective ladder, the shelf is arranged in a desired vertical position with the arm sliding within the slot, and then the anchoring pin is supported upon a respective one of the hooks.

18 Claims, 8 Drawing Sheets

(56) References Cited

U.S. PATENT DOCUMENTS 5,034,861 A 7/1991 Sklenak et al.
5,279,231 A * 1/1994 Kolvites ..... A47B 57/545 108/107
5,287,252 A * 2/1994 Caruso ..... F25D 25/02 312/223.5
5,361,599 A 11/1994 Dasher
5,642,924 A * 7/1997 Wohlrab ..... A47B 57/16 211/134
6,065,821 A 5/2000 Anderson et al.
6,105,233 A * 8/2000 Neal ..... F25D 25/02 29/451
6,584,916 B1 * 7/2003 Felton ..... A47B 46/005 108/107
6,675,725 B2 * 1/2004 Felton ..... A47B 46/005 108/107
6,813,896 B1 * 11/2004 Janke ..... F25D 25/02 62/126
6,817,688 B2 11/2004 O'Halloran
7,007,905 B2 * 3/2006 Roberts ..... A47B 96/061 108/108
7,429,091 B2 * 9/2008 Reed ..... E05D 11/1078 312/351
7,434,951 B2 * 10/2008 Bienick ..... A47B 97/00 362/133
7,472,876 B2 * 1/2009 Jones ..... A47B 96/061 108/108
7,748,806 B2 * 7/2010 Egan ..... A47B 96/02 108/102
7,840,286 B2 11/2010 Caldwell et al.
7,954,797 B2 6/2011 Sasahara
8,038,112 B2 * 10/2011 Kluge ..... A47B 96/1466 248/235
8,123,315 B2 * 2/2012 Hagele ..... A47B 57/425 108/108
8,215,732 B2 * 7/2012 Kim ..... F25D 25/02 108/20
8,282,178 B2 10/2012 Bradley et al.
8,967,740 B2 * 3/2015 Kerner ..... H01R 43/00 312/237
2004/0255607 A1 * 12/2004 Barmann ..... A47B 57/562 62/407
2005/0204966 A1 * 9/2005 Bienick ..... A47B 57/48 108/108
2006/0163985 A1 * 7/2006 Blersch ..... F25D 23/067 312/408
2007/0262220 A1 * 11/2007 Kluge ..... A47B 57/402 248/246
2008/0030114 A1 * 2/2008 Becke ..... A47B 57/425 312/408
2008/0043456 A1 * 2/2008 Bernardini ..... A47B 57/42 362/94
2009/0115302 A1 * 5/2009 Benz ..... A47B 57/562 312/408
2009/0127993 A1 * 5/2009 Hrubesch ..... A47B 57/06 312/408
2010/0133970 A1 * 6/2010 Shin ..... F25D 25/02 312/408
2010/0270251 A1 * 10/2010 Mejac ..... A47B 57/265 211/134
2011/0164399 A1 7/2011 Driver
2012/0006957 A1 * 1/2012 Kluge ..... A47B 96/1466 248/224.8
2012/0043874 A1 * 2/2012 Simpson ..... F25D 23/067 312/408

* cited by examiner

SHELVING ASSEMBLY FOR REFRIGERATOR COMPARTMENT

CROSS REFERENCE TO RELATED APPLICATIONS

This application represents a continuation of U.S. patent application Ser. No. 13/788,418, which was filed on Mar. 7, 2013 and titled "Shelving Assembly for Refrigerator Compartment". The entire content of this application is incorporated by reference.

BACKGROUND OF THE INVENTION

1. Field of the Invention

The present invention pertains to the art of refrigerators and, more particularly, to a shelving assembly used to support vertically adjustable shelves in a compartment of a refrigerator.

2. Description of the Related Art

In the art of refrigerators, it is widely known to employ a plurality of shelves and compartments, including drawers and bins, to store a wide range of food products. In the case of shelves, in order to accommodate varying sized food items to be stored, many different types of shelving systems have been proposed, including shelving assemblies that will enable shelves to be supported at heights that can be varied as desired. Vertically adjustable shelving arrangements for refrigerators typically employ shelf ladders fixedly secured to and projecting from the rear wall of a refrigerator compartment for removably securing hooks of shelf supporting brackets. Current ladder designs can employ about thirty to forty rectangular openings or slots stamped into each one of a pair of spaced elongated steel bars. Overall, the bars with the visual holes can be considered visually unappealing.

SUMMARY OF THE INVENTION

The present invention is directed to a refrigerator shelving assembly which enables various shelves to be supported from ladder rails which are mounted within spaced elongated pockets formed in the rear wall of a compartment of the refrigerator. Each ladder rail presents a front wall portion, a side wall portion, a rear wall portion and, adjacent the front wall portion, a vertical slot which is visible from the front of the refrigerator compartment. The slot is defined, at least in part, by an in-turned portion of the front wall portion. Offset from the slot, behind the front wall portion and spaced forward of the rear wall portion of the ladder rail, the in-turned portion is formed with a plurality of vertically spaced and rearwardly projecting hooks. The hooks are exposed to a receiving zone established within the ladder rail, with the front wall portion including at least one cutout opening into the receiving zone.

Each shelf of the assembly includes arms which interact with the ladder rails to retain the shelves at selected vertical positions with the refrigerator compartment. More specifically, each arm includes an anchoring pin and a support foot. In mounting the shelf, the support foot and the anchoring pin on each arm is positioned within a respective receiving zone by way of one of the cutout openings, while the arm extends through the slot. Once in the receiving zone, the shelf can be freely, vertically adjusted. After a desired vertical mounting position is selected, the anchoring pin is shifted into a position wherein the anchoring pin is retained on a selected hook, while the support foot abuts the rear wall portion of the ladder rail.

With the above arrangement, a fully adjustable, yet aesthetically pleasing, shelving assembly is established. In accordance with other aspects of the invention, visual indicator lines are provided along the front wall portion to reflect the positioning of the hooks and delineate the potential positions for the shelf. In addition, one or more ladder rails cooperate with the support foot to provide power to a lighting arrangement incorporated into the shelf. In any case, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
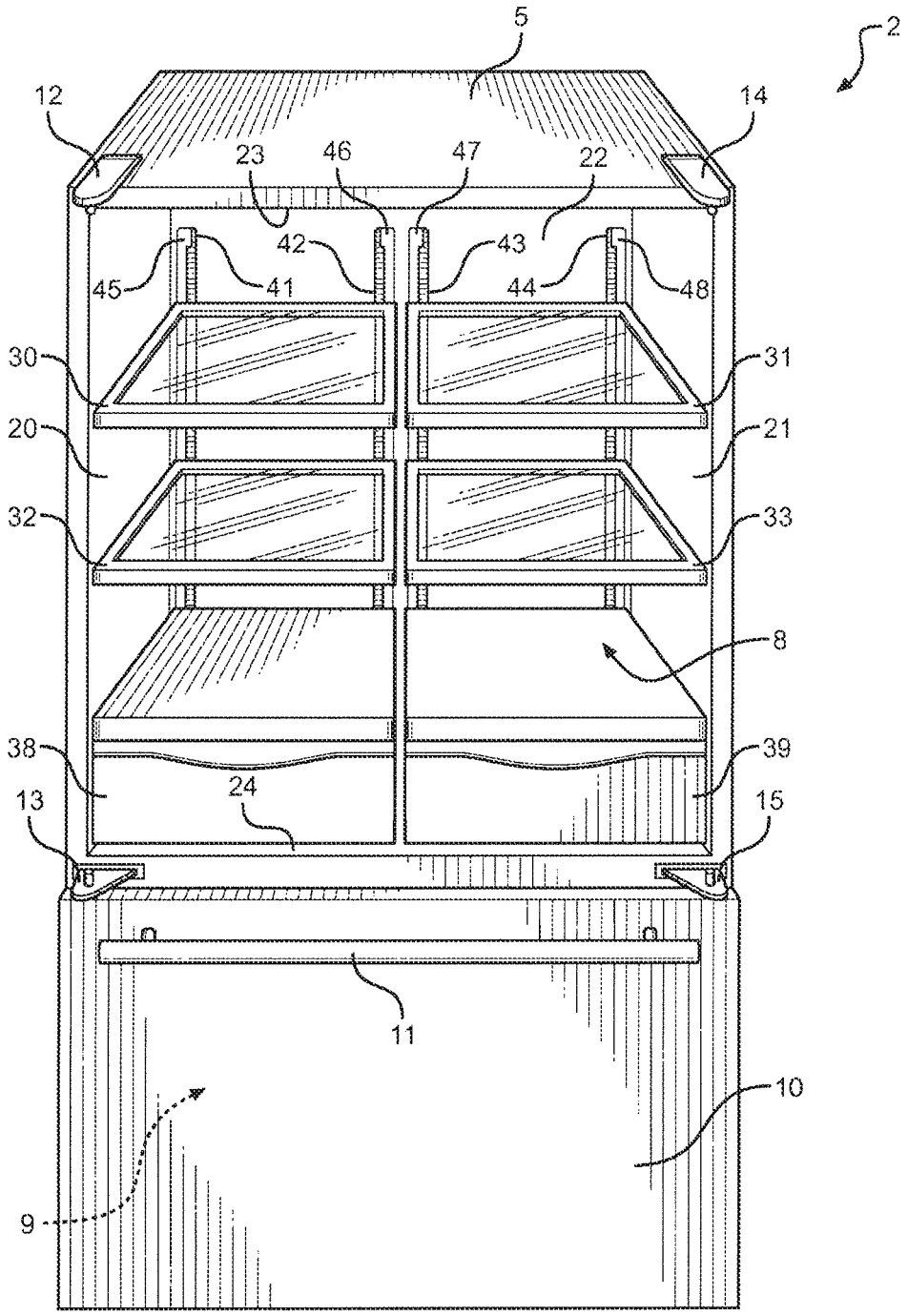
FIG. 1 is a front view of a refrigerator provided with a shelving assembly constructed in accordance with the present invention.

With initial reference to FIG. 1, a refrigerator associated with the present invention is generally indicated at 2. As shown, refrigerator 2 includes a cabinet 5 within which is defined an upper fresh food compartment 8 and a lower freezer compartment 9 located behind a freezer door 10 having a handle 11. Also depicted are pairs of upper and lower hinges 12, 13 and 14, 15 which are used in connection with pivotally mounting French-style upper fresh food compartment doors of refrigerator 2, with the fresh food compartment doors not being shown in order to illustrate internal components of refrigerator 2. Compartment 8 is defined by a liner (not separately labeled) positioned in cabinet 5, with the liner including opposing side walls 20 and 21, a rear wall 22, a top wall 23 and a bottom wall 24. In the embodiment shown, compartment 8 includes a plurality of spaced shelves 30-33, as well as a plurality of storage drawers 38 and 39. More importantly, the present invention is particularly directed to the construction and mounting of one or more of shelves 30-33 through the use of ladder rails 41-44 mounted in pockets 45-48 formed in rear wall 22 as will be detailed more fully below. However, at this point, it should be realized that, although refrigerator 2 is shown to constitute a bottom mount style refrigerator, the invention is equally applicable to other refrigerator styles, including top mount and side-by-side units.

In general, ladder rails 41 and 43 are identically constructed, while ladder rails 42 and 44 are also identically constructed and mirror images of ladder rails 41 and 43. Therefore, a detailed description of ladder rail 42 will be presented with reference to FIGS. 2A and 2B and it is to be understood that corresponding structure exists for ladder rails 41, 43 and 44. As shown, ladder rail 42 includes a front wall portion 52, a side wall portion 54, a rear wall portion 56 and a side flange portion 58. Front wall portion 52 includes an in-turned portion 60 which is spaced from side flange portion 58 by a fore-to-aft gap 64. In addition, in-turned portion 60 is laterally offset from side flange portion 58 in order to establish a vertical slot 66.

Offset from vertical slot 66, behind front wall portion 52 and spaced forward of rear wall portion 56 of ladder rail 38, in-turned portion 60 is formed with a plurality of vertically spaced and rearwardly projecting hooks, one of which is indicated at 72. Each hook 72 defines an arcuate notch 77 and extends towards rear wall portion 56 into receiving zone 78. As also depicted in these figures, front wall portion 52 is provided with an upper opening or cutout 80 for reasons which will be detailed more fully below. Front wall portion 52 can actually be provided with additional vertically spaced cutouts, such as exemplified by cutout 82. At this point, it should simply be recognized that each cutout 82, 82 opens into receiving zone 78. Finally, rear wall portion 56 of ladder rail 38 includes a mounting tab 85 shown to project above a height of front wall portion 52.

Figure 3A:
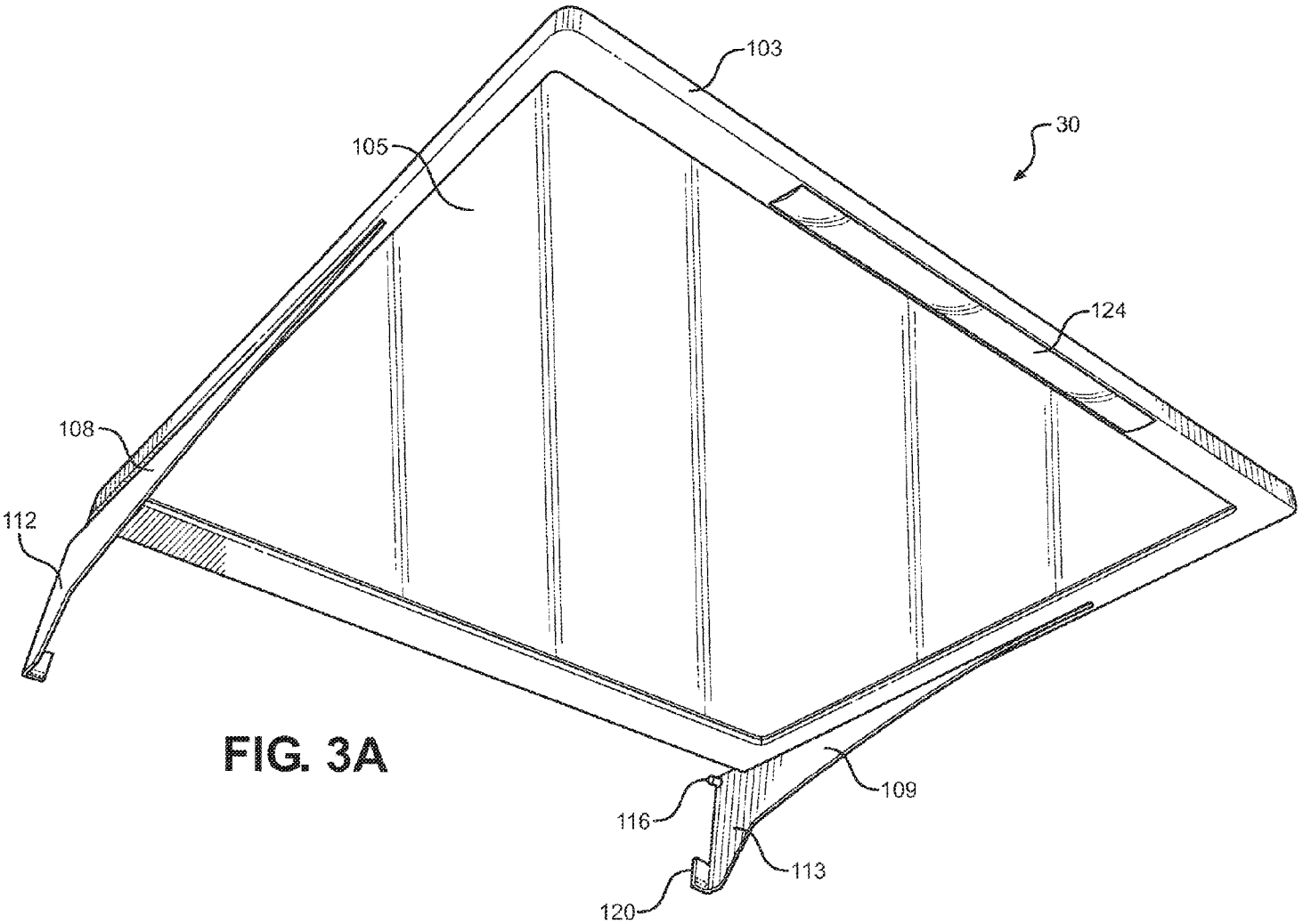
FIG. 3A is a lower perspective view of a shelf of the shelving assembly.
Figure 3B:
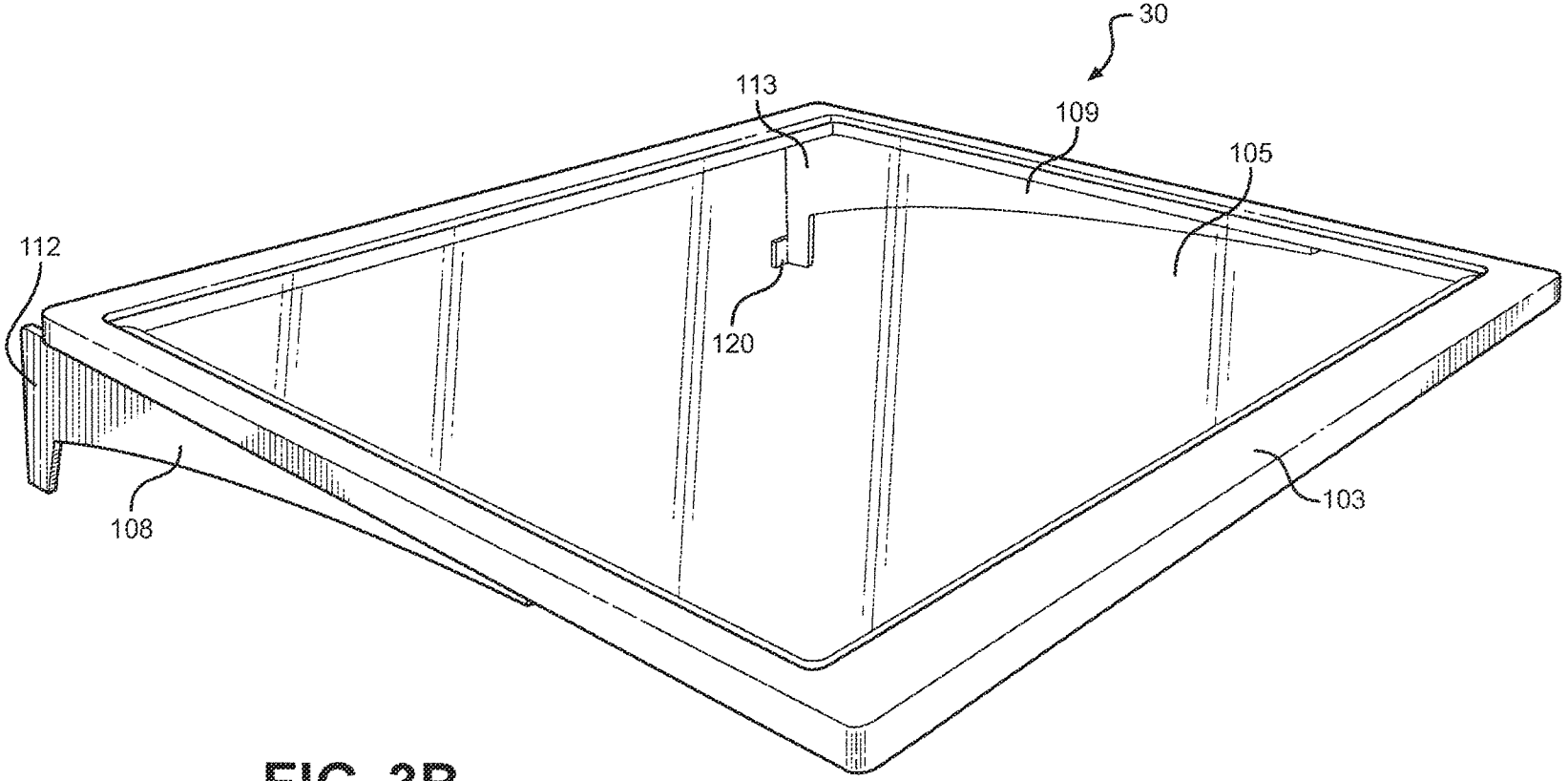
FIG. 3B is an upper perspective view of the shelf of FIG. 3A.

Reference will now be made to FIGS. 3A and 3B in describing details of shelves 30-33. Much like ladder rails 41-44, shelves 30-33 are illustrated to be identically constructed such that a detailed description of shelf 30 will now be provided with reference to these figures and it is to be understood that additional identically or similarly constructed shelves can also be provided within fresh food compartment 8. As illustrated, shelf 30 constitutes a half-shelf, i.e., the shelf extends approximately half the width of compartment 8, and includes a peripheral rim 103 which encapsulates a platform 105 shown to be made of glass. Shelf 30 also includes a pair of side brackets 108 and 109 which terminate in rearwardly projecting arms 112 and 113 respectively. Each arm 112, 113 is provided with an inwardly extending, upper anchoring member or pin 116 and an inwardly extending, lower support foot 120. At this point, it should be recognized that the shelves constructed in accordance with the present invention can actually take various forms and be made from a wide range of materials. In the embodiment shown, peripheral rim 103 is constituted by plastic which is molded around glass platform 105 and integrated with metal side brackets 108 and 109. However, as will become more fully evident below, an important design detail of shelves 30-33 in accordance with the invention is concentrated on the structure of arms 112 and 113, rather than the remainder of each shelf 30-33. As also shown in FIG. 3A, shelf 30 incorporates a lighting unit 124 depicted as being provided along a lower front portion (not separately labeled) of peripheral rim 103.

Figure 4B:
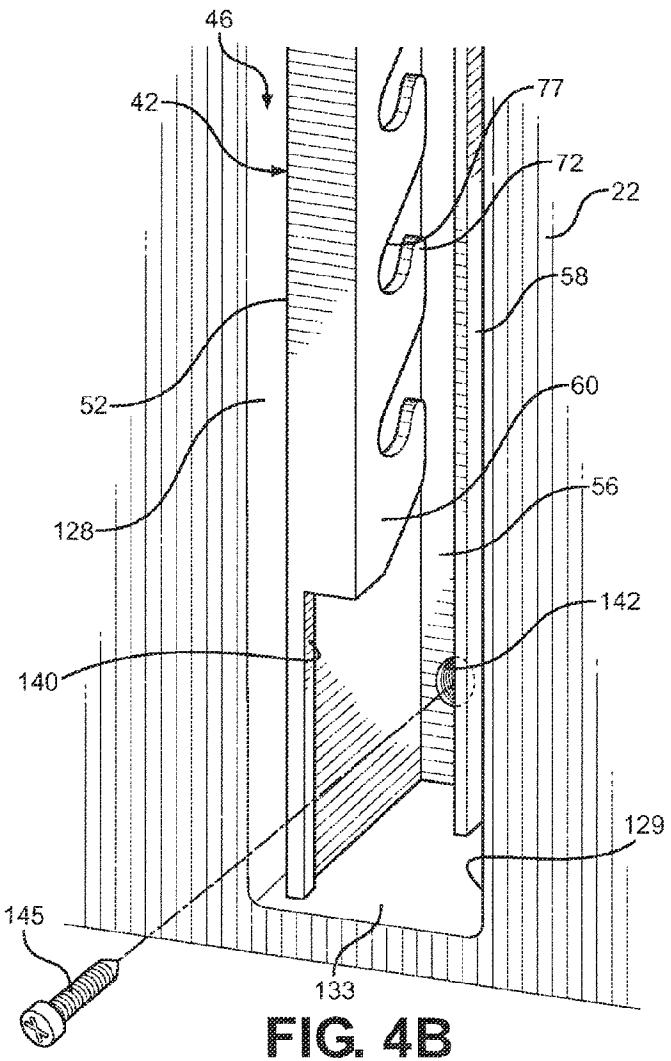
FIG. 4B illustrates a further mounting stage for the ladder rail in a pocket formed in the rear wall of the refrigerator of FIG. 1.
Figure 4A:
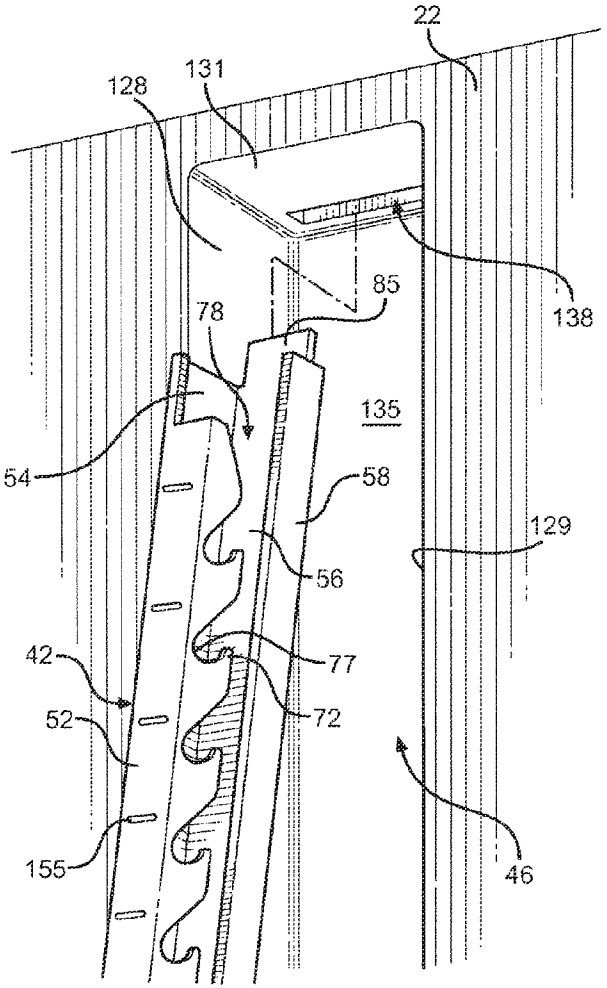
FIG. 4A illustrates an initial mounting stage for the ladder rail in a pocket formed in the rear wall of the refrigerator of FIG. 1.

FIGS. 4A and 4B provide additional details of pockets 45-47, as well as illustrate the manner in which a respective ladder rail 41-44 is mounted therein. For exemplary purposes, these figures detail the construction of pocket 46 in receiving ladder rail 42. As shown, pocket 46 includes pocket side walls 128 and 129, a top wall 131, a bottom wall 133, and a back wall 135. Formed in top wall 131 adjacent back wall 135 is a recess 138. In mounting ladder rail 42 within pocket 46, mounting tab 85 is initially inserted into recess 138 and then ladder rail 42 is pivoted to be fully received within pocket 46. Although various configurations are possible, a preferred embodiment of the invention positions ladder rail 42 within pocket 46 such that front wall portion 52 is either flush with, or spaced behind, rear wall 22. As shown in FIG. 4B, ladder rail 42 includes a lower cutout region 140 which provides access to a through hole 142 formed in rear wall portion 56. In combination with mounting tab 85 being received in recess 138, a mechanical fastener 145 is received within through hole 142 and threadably secures ladder rail 42 in position.

Figure 5:
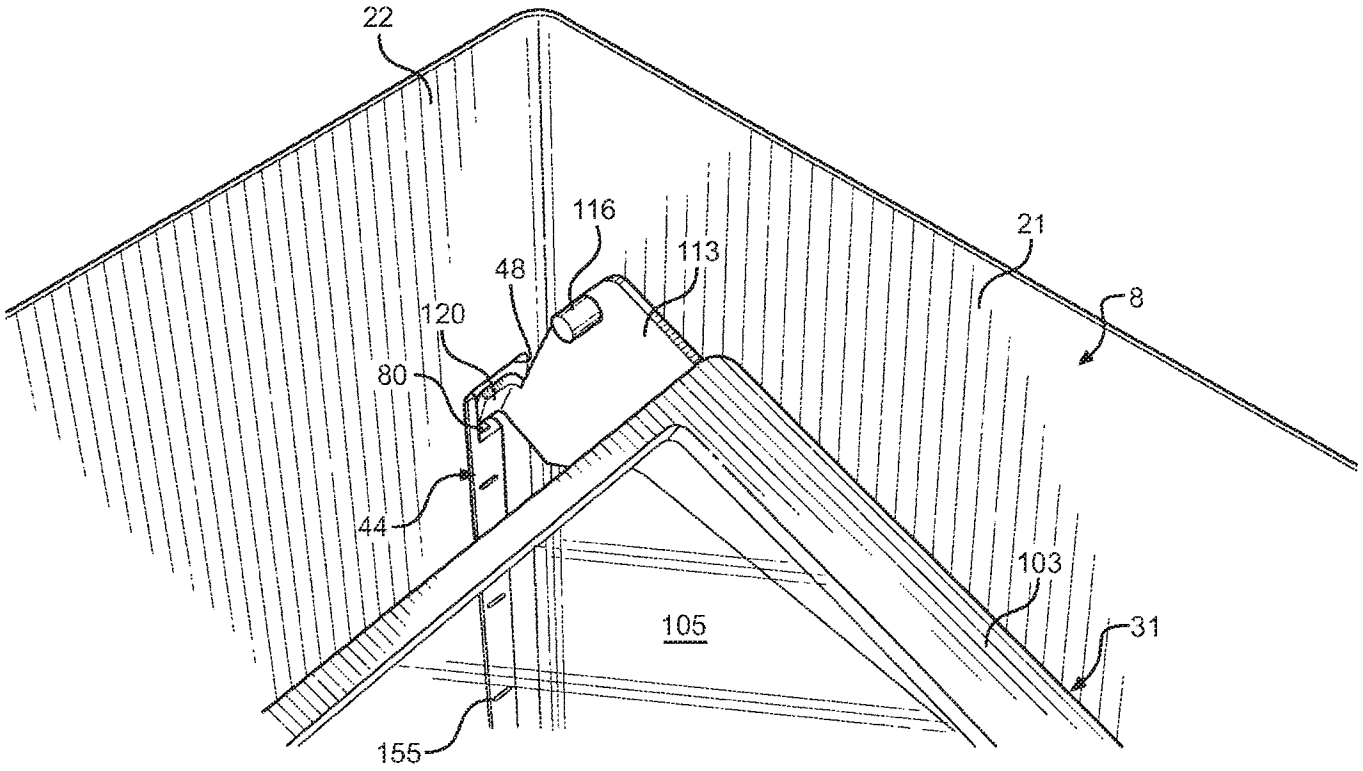
FIG. 5 illustrates the shelf of the invention being initially interengaged with the ladder rail.
Figure 6:
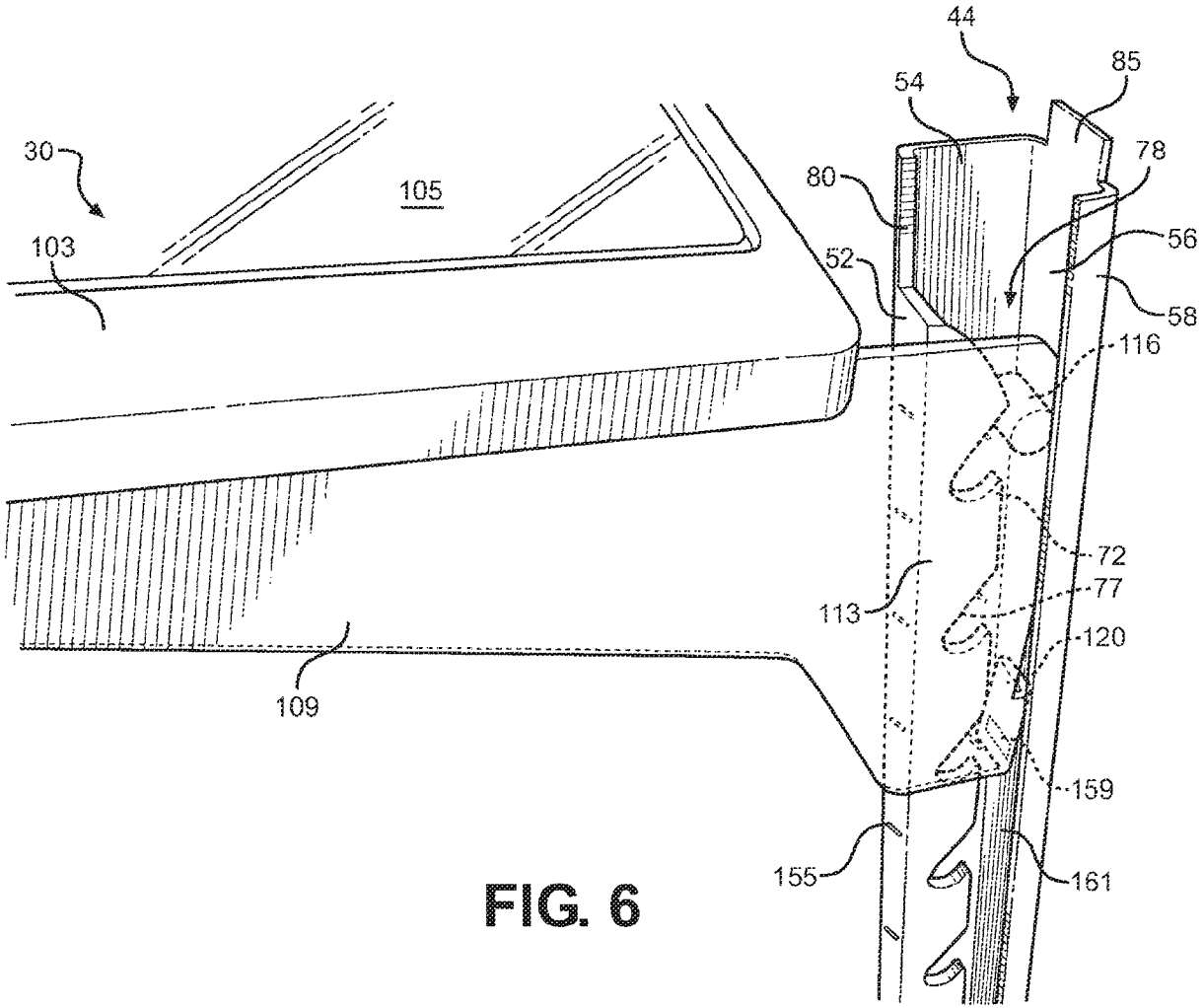
FIG. 6 is a partially side view illustrating the shelf interengaged with the ladder rail while assuming an adjusting position.
Figure 7:
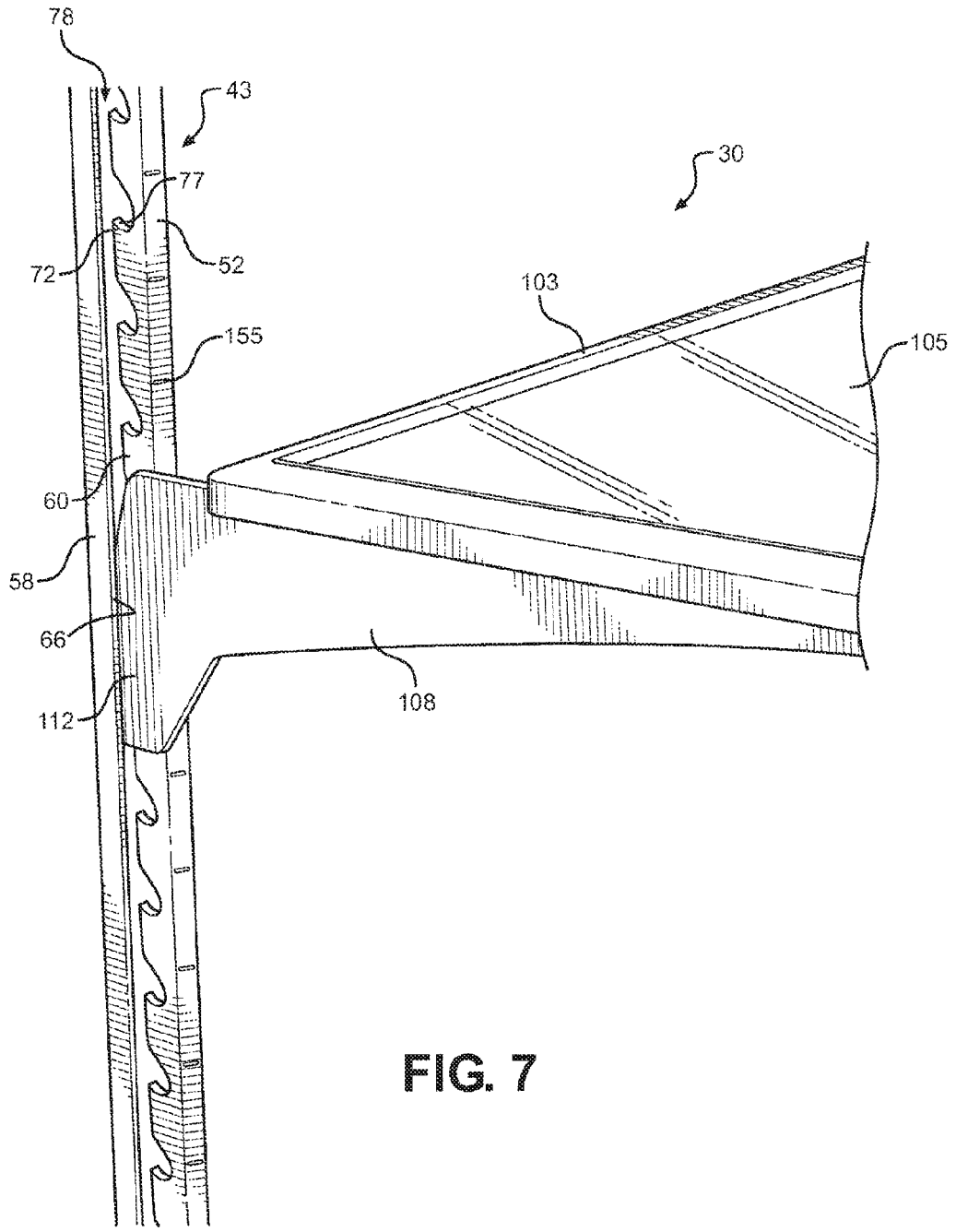
FIG. 7 illustrates the shelf in a final mounting position.

Reference will now be made to FIGS. 5-7 in describing the manner in which shelf 31 is supported at a select vertical position upon ladder rails 43 and 44 within compartment 8. With initial reference to FIG. 5, during initial assembly, support foot 120 is positioned within cutout 80. In this manner, support foot 120 is arranged within receiving zone 78. By moving support foot 120 downward within receiving zone 78, anchor pin 116 can also extend through cutout 80 into receiving zone 78 while arm 113 extends through vertical slot 66 so as to be directly adjacent in-turned portion 60, with in-turned portion 60 on one side of arm 113 and side flange portion 58 being on the other side of arm 113 as perhaps best shown in FIG. 6. With both anchoring pin 116 and support foot 120 positioned rearward of in-turned portion 60, shelf 31 can be vertically repositioned within compartment 8, while being guided through the vertical movement. Once a desired vertical height for shelf 31 is selected, shelf 31 is tilted such that anchoring pin 116 is received within a respective notch 77 of an associated hook 72. At this point, anchoring pin 116 establishes a pivot axis for shelf 31 about which peripheral rim 103 and platform 105 can pivot downward until support foot 120 abuts rear wall portion 56, whereupon platform 105 assumes a substantially horizontal configuration as shown in FIGS. 1 and 7.

Figure 2A:
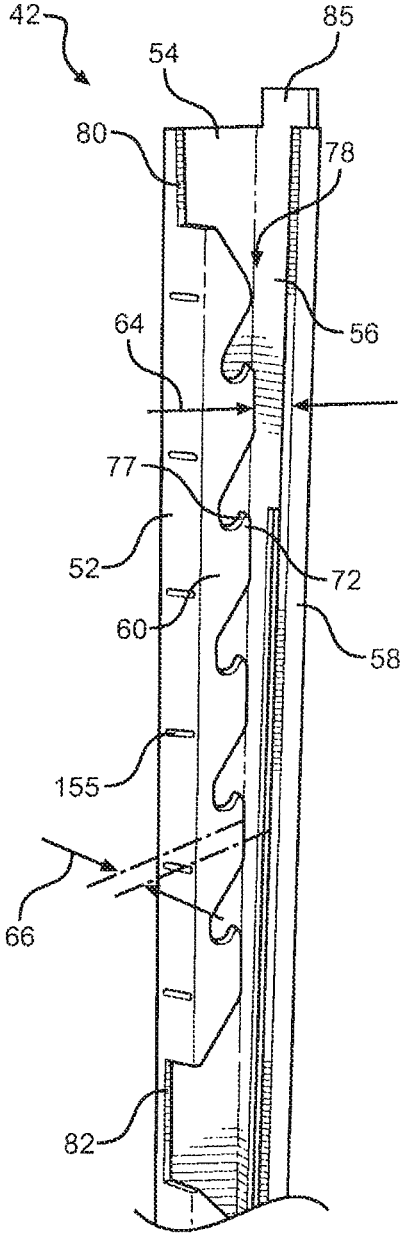
FIG. 2A is a front perspective view of a ladder rail of the shelving assembly.
Figure 2B:
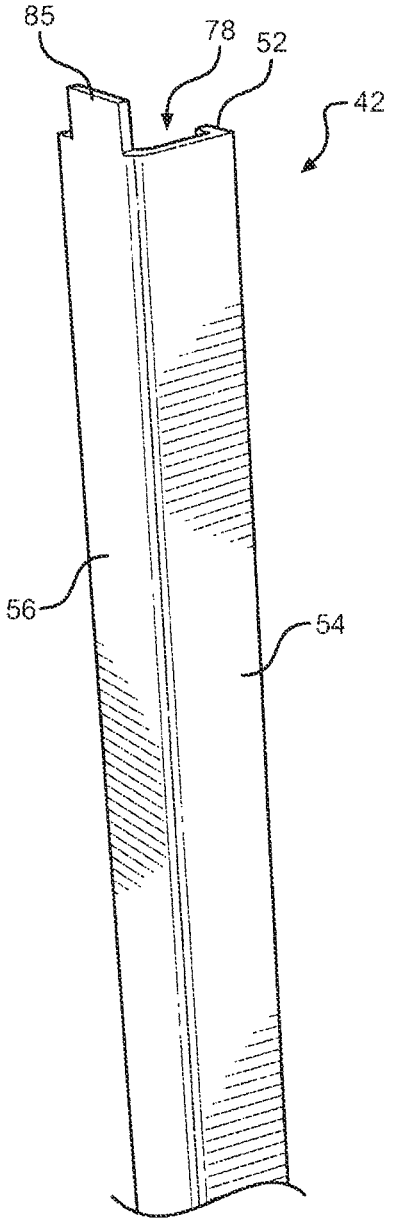
FIG. 2B is a rear perspective view of the ladder rail of FIG. 2.

With the above configuration, it should be readily apparent that hooks 72 are not visible from a front view of compartment 8. Instead, with ladder rails 41-44 being located in pockets 45-48 and ladder rails 41-44 being configured as described above, it is only apparent that arms 112 and 113 extend from respective vertical slots 66. The loading of shelves 30-33 with food items merely enhances the rigidity of the mounting configuration by further retaining each anchoring pin 116 in the notch 77 of a selected hook 72. Still, each shelf 30-33 can be readily, vertically adjusted by simply lifting and angling the shelf 30-33 backwards, slidably repositioning the shelf with anchoring pin 116 being within receiving zone 78 and spaced from hooks 72 as discussed above with reference to FIG. 6, and then reengaging anchoring pin 116 with another hook 72. Since hooks 72 are not visually apparent, the front wall portion 52 of each ladder rail 41-44 is shown to include various visual indicator lines, such as indicated at 155 in FIGS. 2A, 4A and 5-7 to assist a user in locating a desired mounting position. With the inclusion of one or more additional cutouts, such as cutout 82 in front wall portion 52 as shown in FIG. 2A, a given shelf 30-33 can be readily attached to or removed from respective ladder rails 41-44 at different vertical height positions.

In accordance with the embodiment wherein one or more of shelves 30-33 includes a lighting unit, such as lighting unit 124, it is preferred to transfer power to lighting unit 124 through this overall rail mounting arrangement. To this end, FIG. 6 illustrates the inclusion of an electrical contact 159 provided on a back surface (not separately labeled) of support foot 120 which comes into contact with a power strip 161 mounted on rear wall portion 56. Although not shown, wires or other electrical conducting members are provided as part of shelf 31 to provide electricity between contact 159 and lighting unit 124.

Although described with reference to preferred embodiments of the invention, it should be readily understood that various changes and/or modifications can be made to the invention without departing from the spirit thereof. For instance, while four laterally spaced pockets are presented in the illustrated embodiment, it should be recognized that only two pockets need be employed for shelves extending across the entire width of the compartment and, even in the case of half-shelves, the center two pockets could be combined by forming one larger pocket. In general, the invention is only intended to be limited by the scope of the following claims.

The invention claimed is:

1. A refrigerator comprising:

a cabinet within which is established a refrigerated compartment defined, at least in part, by a rear wall;

a plurality of ladder rails spaced along the rear wall of the refrigerated compartment, each of the ladder rails including a front wall portion and a plurality of vertically spaced hooks projecting rearwardly from the front wall portion, each of the plurality of hooks defining an arcuate notch, wherein a distal edge section of the front wall portion is turned inward from a remainder of the front wall portion so as to project rearwardly, the distal edge section being provided with the plurality of hooks; and a shelf mounted upon the plurality of ladder rails within the refrigerated compartment, the shelf including laterally spaced and rearwardly projecting arms with each arm including an anchoring pin, the shelf being adjustably supported by the plurality of ladder rails in a select vertical position within the refrigerated compartment with the anchoring pin of each arm being retained in a respective said arcuate notch on a select one of the plurality of hooks.

2. The refrigerator of claim 1, wherein the anchoring pin of each said arm is configured to establish a pivot axis for the shelf when the anchoring pin of each said arm is retained on a select one of the plurality of hooks.

3. The refrigerator of claim 1, wherein the distal edge section is formed integrally with the front wall portion.

4. The refrigerator of claim 1, wherein the rear wall of the refrigerated compartment is formed with a plurality of spaced elongated pockets, each of the plurality of ladder rails being mounted in a respective one of the plurality of pockets.

5. The refrigerator of claim 4, wherein:

each of the plurality of pockets is defined by pocket side walls;

the plurality of hooks is spaced from a respective one of the pocket walls to establish a slot; and each arm of the shelf projects through a respective said slot.

6. The refrigerator of claim 4, further comprising:

a recess formed in each of the plurality of pockets; and a tab projecting from each of the plurality of ladder rails, each of the plurality of ladder rails being mounted in a respective one of the plurality of pockets with the tab projecting into the recess.

7. The refrigerator of claim 4, wherein the front wall portion of each of the plurality of ladder rails is mounted in a respective one of the plurality of pockets without extending forward of the rear wall of the refrigerated compartment.

8. The refrigerator of claim 1, wherein each said arm of the shelf further includes a support foot abutting a rear wall portion of a respective said ladder rail.

9. The refrigerator according to claim 8, further comprising:

a light provided on the shelf, the light being powered through an electrical contact established between the support foot and the rear wall portion of the respective said ladder rail.

10. A refrigerator comprising:

a cabinet within which is established a refrigerated compartment defined, at least in part, by a rear wall;

a plurality of ladder rails spaced along the rear wall of the refrigerated compartment, each of the plurality of ladder rails including a front wall portion, a rear wall portion and a side wall portion, a distal edge section of the front wall portion being turned inward from a remainder of the front wall portion so as to project rearwardly, the side wall portion interconnecting and maintaining a spacing between the front and rear wall portions such that a receiving zone is established within each said ladder rail, with the front wall portion being formed with at least one cutout opening to the receiving zone and the distal edge section being provided with a plurality of vertically spaced and rearwardly projecting hooks; and a plurality of shelves for mounting upon the plurality of ladder rails within the refrigerated compartment, each of the plurality of shelves including laterally spaced and rearwardly projecting arms with each arm including an anchoring member, and each of the shelves being configured to be supported by the plurality of ladder rails in a select vertical position within the refrigerated compartment with the anchoring member of each said arm being introduced into the receiving zone through the at least one cutout and retained on a select one of the plurality of hooks.

11. The refrigerator of claim 10, wherein the distal edge section is formed integrally with the front wall portion.

12. The refrigerator of claim 10, wherein the rear wall of the refrigerated compartment is formed with a plurality of spaced elongated pockets, each of the plurality of ladder rails being mounted in a respective one of the plurality of pockets.

13. The refrigerator of claim 12, wherein:

each of the plurality of pockets is defined by pocket side walls;

the plurality of hooks is spaced from a respective one of the pocket walls to establish a slot; and each said arm of the plurality of shelves projects through a respective slot when the plurality of shelves shelf is supported by the plurality of ladder rails.

14. The refrigerator of claim 10, wherein each said arm of the plurality of shelves further includes a support foot abutting a rear wall portion of a respective ladder rail.

15. A method of mounting a shelf within a refrigerated compartment of a refrigerator comprising:

mounting a plurality of ladder rails at spaced locations along a rear wall of the refrigerated compartment, each of the ladder rails including a front wall portion and a plurality of vertically spaced hooks projecting rearwardly from the front wall portion, each of the plurality of hooks defining an arcuate notch, wherein a distal edge section of the front wall portion is turned inward from a remainder of the front wall portion so as to project rearwardly, the distal edge section is formed integrally with the front wall portion and the distal edge section is provided with the plurality of hooks;

inserting an anchoring pin projecting from an arm of a shelf into a receiving zone of a respective one of the plurality of ladder rails;

shifting the shelf vertically relative to the plurality of ladder rails in order to locate the shelf in a desired vertical position within the refrigerated compartment; and positioning the anchoring pin in a respective said arcuate notch and upon a select one of the plurality of hooks by positioning the anchoring pin in contact with the distal edge section to mount the shelf for use in supporting food items within the refrigerated compartment.

16. The method of claim 15, further comprising:

after positioning the anchoring pin upon the select one of the plurality of hooks, pivoting the shelf about a pivot axis established by the anchoring pin.

17. The method of claim 15, wherein:

the rear wall of the refrigerated compartment is formed with a plurality of spaced elongated pockets; and mounting the plurality of ladder rails includes mounting each of the plurality of ladder rails in a respective one of the plurality of pockets.

18. The method of claim 17, wherein each of the pockets is defined by pocket side walls; and the plurality of hooks is spaced from a respective one of the pocket walls to establish a slot, said method further comprising:

inserting the anchoring pin into the receiving zone by positioning the arm of the shelf in the slot.

* * * * *